US010508473B2

(12) United States Patent
Pietrow

(10) Patent No.: US 10,508,473 B2
(45) Date of Patent: Dec. 17, 2019

(54) COMPACT OPERATING UNIT FOR A SAFE LOCK

(71) Applicant: Mitteldeutsche Tresorbau GmbH, Leipzig (DE)

(72) Inventor: Eugeniusz Pietrow, Stara Zagora (BG)

(73) Assignee: Mitteldeutsche Tresorbau GmbH, Leipzig (DE)

( * ) Notice: Subject to any disclaimer, the term of this patent is extended or adjusted under 35 U.S.C. 154(b) by 0 days.

(21) Appl. No.: 15/506,762

(22) PCT Filed: Aug. 27, 2015

(86) PCT No.: PCT/DE2015/100353
§ 371 (c)(1),
(2) Date: Feb. 27, 2017

(87) PCT Pub. No.: WO2016/029905
PCT Pub. Date: Mar. 3, 2016

(65) Prior Publication Data

US 2017/0254120 A1 Sep. 7, 2017

(30) Foreign Application Priority Data

Aug. 27, 2014 (DE) ..... 10 2014 112 319

(51) Int. Cl.

| | |
|---|---|
| ***E05B 65/00*** | (2006.01) |
| ***E05G 1/04*** | (2006.01) |
| ***E05B 47/00*** | (2006.01) |
| ***E05B 37/08*** | (2006.01) |
| ***E05B 47/06*** | (2006.01) |
| ***E05B 49/00*** | (2006.01) |

(Continued)

(52) U.S. Cl.
CPC ..... *E05B 65/0075* (2013.01); *E05B 1/0092* (2013.01); *E05B 13/103* (2013.01); *E05B 37/08* (2013.01); *E05B 47/0012* (2013.01); *E05B 47/068* (2013.01); *E05B 49/00* (2013.01); *E05G 1/04* (2013.01); *E05B 2047/002* (2013.01)

(58) Field of Classification Search
CPC .... E05B 13/103; E05B 47/00; E05B 47/0001; E05B 47/0012; E05B 2047/0014; E05B 2047/0018; E05B 2047/002; E05B 2047/0048; E05B 2047/0072; E05B 49/00; E05B 65/0075; E05G 1/04
See application file for complete search history.

(56) References Cited

U.S. PATENT DOCUMENTS

| | | | |
|---|---|---|---|
| 5,017,851 | A | 5/1991 | Heinzman |
| 5,061,923 | A | 10/1991 | Miller |

(Continued)

FOREIGN PATENT DOCUMENTS

| | | | |
|---|---|---|---|
| CA | 2373022 | A1 | 11/2000 |
| EP | 0408953 | A2 | 1/1991 |
| FR | 1 169797 | A | 1/1959 |

*Primary Examiner* — Christopher J Boswell
(74) *Attorney, Agent, or Firm* — James Creighton Wray

(57) ABSTRACT

A control unit 1 for the lock of a safe having a front housing part 4 and a rear h housing part 3. A controller 6 is integrated in the control unit 1 that, when a correct combination is entered in the keypad 5, moves a module through a motor 11 in the number of turns corresponding with this combination. The module has a transmission board 8 integrated in the housing 2 of the control unit 1 and a bolt 9 for actuating the safe's lock.

15 Claims, 6 Drawing Sheets

(51) Int. Cl.
*E05B 1/00* (2006.01)
*E05B 13/10* (2006.01)

(56) References Cited

U.S. PATENT DOCUMENTS

| | | | | |
|---|---|---|---|---|
| 5,184,491 | A | 2/1993 | Schittenhelm | |
| 5,609,051 | A * | 3/1997 | Donaldson | E05B 47/0673 340/5.54 |
| 5,887,467 | A | 3/1999 | Butterweck | |
| 6,016,677 | A * | 1/2000 | Clark | E05B 17/2092 70/416 |
| 6,098,433 | A * | 8/2000 | Maniaci | E05B 47/0002 292/144 |
| 6,116,066 | A * | 9/2000 | Gartner | E05B 41/00 292/348 |
| 8,091,392 | B2 * | 1/2012 | Miller | E05B 9/00 70/333 A |
| 8,635,893 | B2 * | 1/2014 | Miller | E05B 49/00 70/283 |
| 9,051,761 | B2 * | 6/2015 | Romero | E05B 37/00 |
| 9,340,999 | B2 * | 5/2016 | Romero | E05B 47/0684 |
| 9,487,971 | B2 * | 11/2016 | Quach | E05B 47/0012 |
| 9,546,504 | B2 * | 1/2017 | Overgaard | E05B 47/02 |
| 2002/0056300 | A1 * | 5/2002 | Pierre | E05B 47/0688 70/303 A |
| 2008/0196457 | A1 * | 8/2008 | Goldman | E05B 13/103 70/224 |
| 2014/0109633 | A1 * | 4/2014 | Romero | E05B 47/0684 70/133 |
| 2016/0251876 | A1 * | 9/2016 | Carlsson | E05B 47/0012 70/445 |
| 2018/0108196 | A1 * | 4/2018 | Abner | G07C 9/00174 |

* cited by examiner

COMPACT OPERATING UNIT FOR A SAFE LOCK

This application claims the benefit of German Application No. 10 2014 112 319.0 filed Aug. 27, 2014, and PCT/DE2015/100353 filed Aug. 27, 2015, International Publication No. WO 2016/029905 A1, which are hereby incorporated by reference in their entirety as if fully set forth herein.

The invention involves a control unit for a safe lock with a multipart housing that has a front housing part and a rear housing part.

Familiar safe locks can be unlocked by entering the correct sequence of numbers or digits by means of the control unit assigned to the lock. Reference is made to U.S. Pat. No. 5,184,491, 5,017,851 or U.S. Pat. No. 5,061,923. For this purpose, the housing or a housing part of the control unit is turned until the number corresponding to the respective positioning is reached. Because the code has several digits, this necessitates multiple turns, where necessary in contrary directions as well. Along with the multidigit code, the user therefore has to know the number and directions of the turns, in particular the direction of the first turn, and may not make a single mistake in these various processes, otherwise the procedure always starts again from the beginning. In brief, opening previously known locks is extremely inconvenient and prone to error, without there being any security advantage involved.

The present invention therefore faces the task of creating a control unit for the lock of a safe door that is characterised by particularly easy handling with simultaneous compliance with the highest security standards.

This task is solved by a controller being integrated in the control unit that, when a correct combination is entered in the keypad, sets a module that has a transmission board arranged in the housing of the control unit and a bolt for actuating the safe's lock in motion through a motor by the number of turns corresponding with this combination.

The unit for the safe lock in accordance with the invention is operated initially solely by means of the keypad. After a correct combination is entered using the keypad, there is a corresponding signal to a controller integrated in the control unit. Through this, a motor is started in order to rotate the module that consists of the transmission board positioned at the end of the housing towards the safe door and the bolt and that is allocated to the rear housing part. These rotations correspond to the combination entered in the keypad. Therefore, if a correct combination is entered in the control unit, the controller takes over the number of turns in the correct combination and sequence corresponding to the one entered with the keypad that is necessary to release the control unit or open the locking device. Hereby the module at or in the rear housing part, consisting of at least the two separate components transmission board and bolt, rotates. Operating using a keypad provides a whole series of advantages here, among other things it is remarkably easy to carry out a reset for the control unit in this way with corresponding reprogramming.

In a further step it is provided that a release is then carried out through the control unit that enables manual adjustment of the front housing part as against the rear housing part between a normal position and a function position, whereby in the last-mentioned position the front housing part can be rotated against the rear housing part. If the correct code is now entered, the control unit turns the transmission board and the bolt as well, so that the control unit is released. After this, the front housing part is moved into the function position, depending on the control unit type in that, for example, the front part is pulled out of the normal position with regard to the rear housing part or is pushed into the latter. In order to bring the lock into the opened state the front housing part must now by turned by a specific angle.

A preferred embodiment of the invention provides specifically that the front housing part is adjustable with regard to the rear housing part in the direction of their common longitudinal axis between the normal position and the function position by pulling or pressing, depending on the design of the control unit. Along with an adjustment of the front housing part by turning to actually open the lock, it is also provided that the front housing part is adjustable with regard to the rear housing part in the direction of their common lengthwise axis between a normal position and a pulled out position. In precise terms, this means that in the closed position the front housing part is in a normal position. If the correct combination is now entered and the controller has ensured the corresponding turns of the transmission board and bolt, so that the control unit is released, the front part can be pulled out slightly from the normal position with regard to the rear housing part or, in an alternative design, be swivelled as well. A mechanism, which will be explained below, then takes effect that enables access to the locking device via the control unit.

It is additionally advantageous that a handle is integrated in the front housing part that moves the front housing part between the normal position and the normal position when it is actuated, because the handle does without the need for controls on the housing parts.

It has already been mentioned that the housing of the control unit consists of a front part, facing away from the safe door and a rear part, facing towards the safe door. It is advantageous here if the keypad is integrated in the front housing part. This means that when the front housing part is turned, the keypad turns as well. This has the further advantage that it can be seen at first glance that the front housing part has been turned, in order to be able to preclude an unintended open position of the control unit or locking of the lock.

It has already been mentioned that the transmission board, which forms a common module with the bolt, carries out a multipole function. The transmission board is also somewhat important because the front housing part and the transmission board are connected non-positively with one another in the pulled out position of the front housing part. If the front housing part is in its rear normal position, the front housing part and the transmission board are not connected with one another. The transmission board and the bolt cannot be operated via the front housing part. To do this, after release of the control unit pulling the front housing part out first and leaving the normal position forwards are necessary, because the front housing part and the transmission board then intermesh and the torque can be transmitted thanks to this non-positive connection.

One advantageous embodiment of the invention provides that a gear connection serves for the non-positive connection. For this purpose, the front housing part has an inner rim on its underside, which corresponds to a number of teeth forming an outer rim on the outside of the transmission board.

Beyond this function, as a multifunction component the transmission board has an additional central task, in that a rim extends in the axial direction of the transmission board that maps the turns of the front housing part in interplay with a sensor integrated in the control unit. This rim is designed in such a way that in the end it corresponds to the numbers for the code. The interplay between the gear rim and the sensor therefore records the point to which the controller turns the module consisting of the transmission board and the bolt in each case.

In tangible terms, in accordance with an advantageous embodiment this means that the rim has a number of openings that correspond to the code for the control unit. Therefore, if the sensor records a turn of the housing part with regard to the rim by a specific number of these small openings, this coincides correspondingly to a turn of the module. In this way, a technology is created that is equally safe from tampering and not susceptible to malfunctions.

A further design provides that at least one of the housing parts can be pivoted, whereby turning is intended primarily to be able to remove the housing from the safe door if necessary. The control unit in accordance with the invention namely enables the safe lock to be operated even if, for example, there is a power failure. This is helpful in that there is still scepticism on the market regarding electronic components in the context of opening safe locks, particularly as people want to keep to established mechanical solutions, which the present invention enables at least as an emergency solution. The suggestion starts from here, in that the two housing parts are designed to be removable, so that the lock can in the end be operated manually as well. Prerequisite for this is turning the two housing parts, preferably in opposite directions.

In this context as well the transmission board comes into play as a multifunction component, if it fulfils the additional purpose that the transmission board serves to open the lock when the front and rear housing parts are removed, in that access to the transmission board is then exposed and this board serves as a component for entering the code.

This mechanism is supported by the transmission board having a scale on its front. In the proven way, manual adjustment is carried out by means of orientation towards the code via the correct input numbers. In order to be able to be guided by these numbers, the latter are provided around the transmission board by means of the scale.

To simplify operations for the mechanical opening of the lock it is provided for the transmission board to have a gear rim on the front that extends parallel to the ring with the openings corresponding to the code.

The invention is characterised in particular in that a compact control unit for a safe door is created that considerably simplifies the handling of the control unit for opening a safe lock and without this being linked with any disadvantages with regard to security. In addition, thanks to its compactness this control unit can be installed on any safe door without any retrofitting effort. The user no longer turns the front housing part of the control unit to set the combination, as before, this is done by a controller integrated in the control unit. Instead, all the user has to do is to enter the correct code via the keypad allocated to the front housing part of the control unit, which the controller then understands as a signal to carry out the release of the turns of the front housing part that concern the control unit with the support of a motor. When this is done, an assembly is rotated comprising a transmission board and a bolt engaging in the door as component of the rear housing part. Here, the transmission board, as a multifunction component, makes a significant contribution to the compactness of this control unit. If the entered code is correct, there is a signal for the user, for example, through a lamp integrated in the keypad, who now moves at least the front housing part having the keypad between its normal position and its function position, in order to operate the actual lock. Along with this function, the transmission board has the task of creating the non-positive connection to the front housing part in the latter's appropriate position, in which it is possible to exercise the torque between front housing part and bolt. An additional function of this transmission board consists in enabling mechanical access to the safe lock when the housing is removed, in that the code is entered by means of corresponding turns of the transmission board. Finally, a further function of this board is a rim positioned on the board and extending vertically to this, which, in interplay with a sensor, reproduces the turns of the front housing part in the normal condition—that is, without a dismantled housing. Here, openings in the rim correspond to the possible adjustments, that is, the numbers for the code.

Additional details and advantages of the subject-matter of the invention can be taken from the following description of the corresponding drawing, in which a preferred example for carrying the invention is shown with the details and the parts that are required for this.

DETAILED DESCRIPTION

Figure 1:
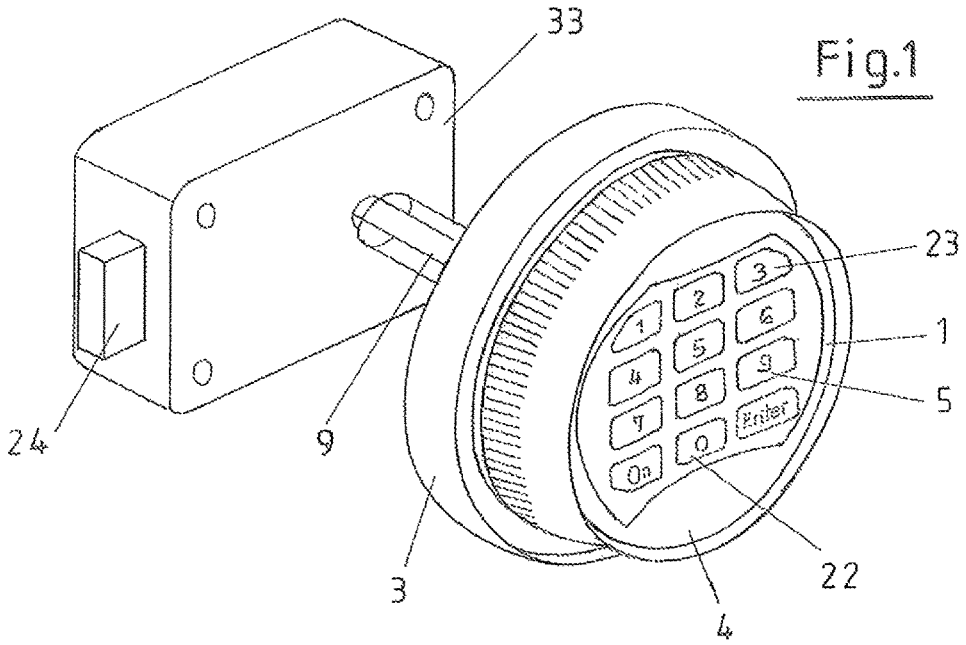
FIG. 1 Shows a control unit and a lock housing in the closed position.

Without the safe door, FIG. 1 shows a control unit 1 and a lock housing 33, connected via the bolt 9, in the closed position. The catch 24 projects to the side out of the lock housing 33. Bolt 9 must be rotated to operate it. Prerequisite for this is first of all the input of the correct code by means of the keypad 5 in the front housing part 4 facing away from the safe door. As an example, two keys 22 and 23 are shown with reference numbers.

Figure 2:
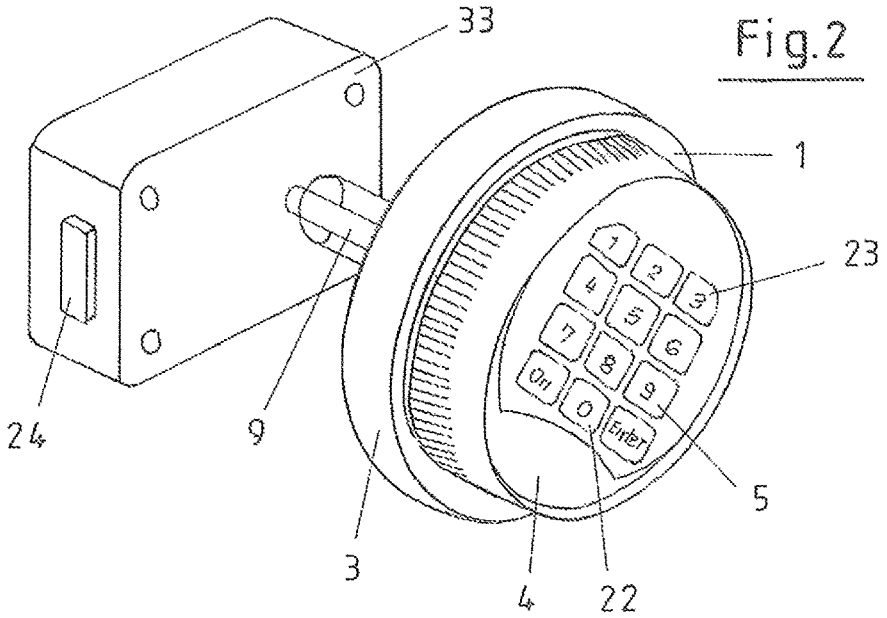
FIG. 2 Shows a control unit and a lock housing in the open position.

The illustration in FIG. 2 shows the unit consisting of the lock housing 33 and the control unit 1 after a turn of the front housing part 4 in a clockwise direction to open the door, which can be recognised very clearly by means of the turned keypad 5, which makes it possible for the user to ascertain at first glance that the safe door is not locked and that therefore there is possibly a need for action. Turning the housing 2 or the front housing part 4 now makes it possible to apply the torque to the bolt 9, so that the catch 24 can be pushed into the opened position shown here.

Figure 3:
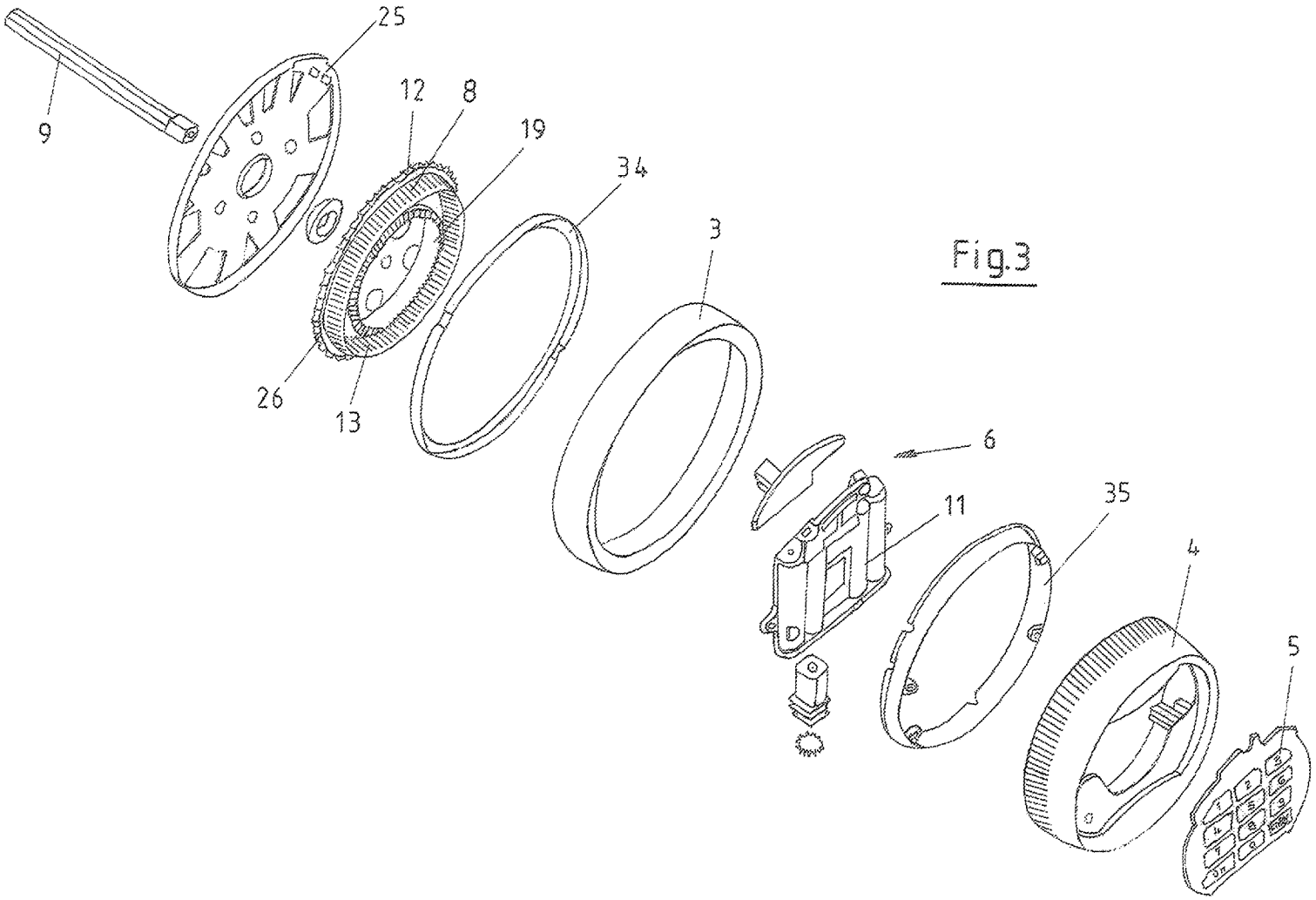
FIG. 3 Shows an exploded view of the essential components.

FIG. 3 shows the components of the housing 2 in an exploded view. The bolt 9 can be seen, which forms a joint module with the transmission board 8. On the front side 20 opposite the bolt 9 the transmission board 8 has the rim 13 and on its outside the gear rim 12. The base plate 25 is used to fasten the housing 2 to the safe door. A spacer 34 follows and then the rear housing part 3 in the form of a ring, which can be fitted in a single position only. The controller along with the energy supply is then designated generally with the reference number 6 and the motor with 11. A further space ring shows the reference number 35 and the front housing part 4 plus keypad 5 then forms the front closure of the housing.

Figure 4:
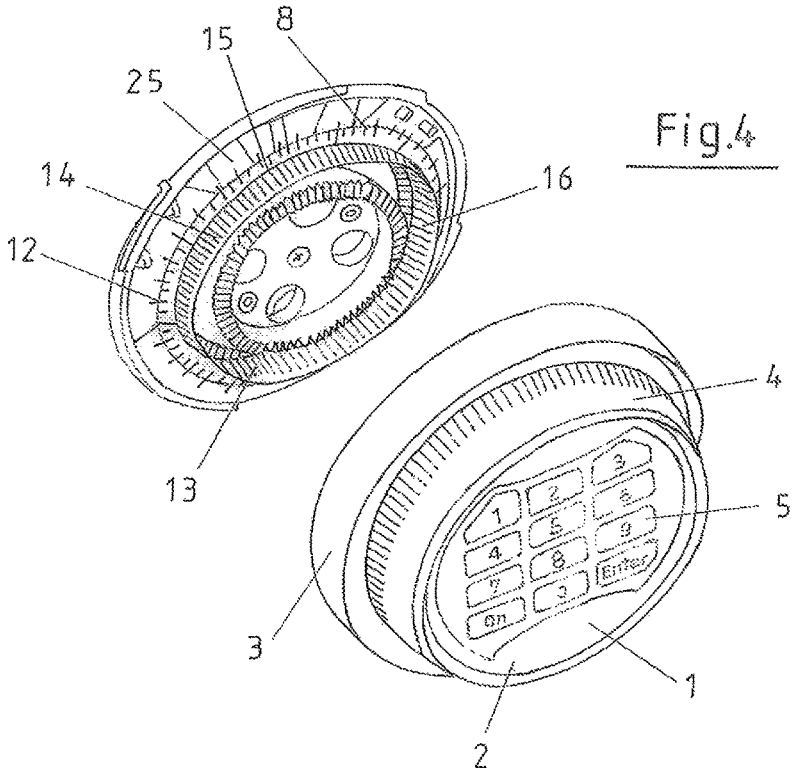
FIG. 4 Shows a perspective view of the control unit and a transmission board, FIG. 5 Shows a top view of a transmission board, FIG. 6 Shows the interior of the control unit in the normal position and FIG. 7 Shows control unit in accordance with FIG. 6 after pulling out.

FIG. 4 shows the housing 2 with the front housing part 4 and the rear housing part 3 and the keypad 5 on the one hand and a transmission board 8 together with the base plate 25 on the other hand. The external gear rim 12 with a great number of teeth positioned running all round can be clearly seen. The same applies to the rim 13 projecting from the surface of the transmission board 8, which shows the setting in interaction with a sensor that is assigned to housing 2 and is not shown here. Three of the corresponding holes show the reference numbers 14 to 16.

Figure 5:
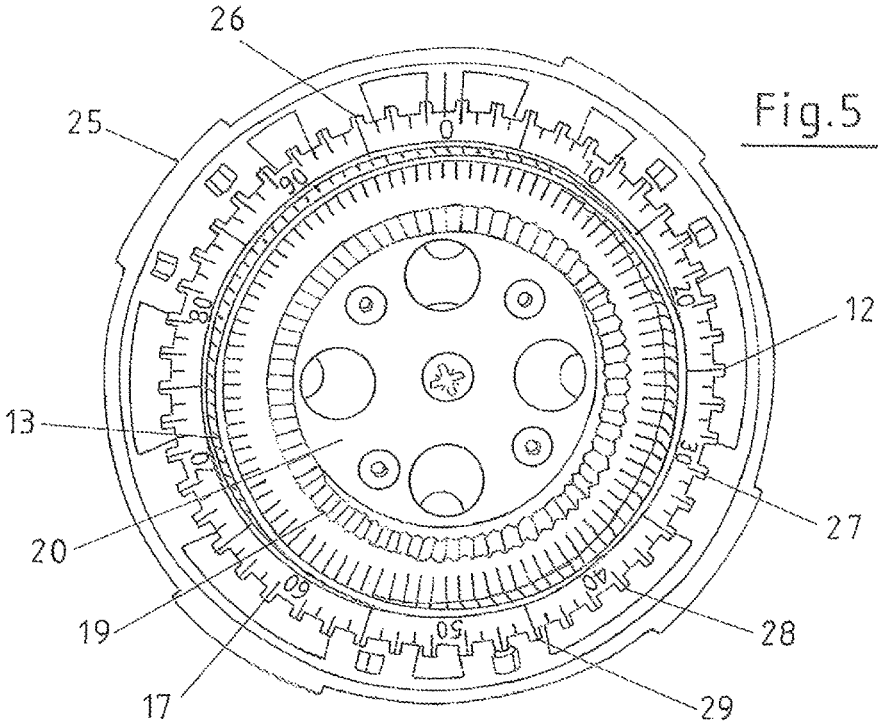

In the top view FIG. 5 shows the multifunction component transmission board 8 in conjunction with the base plate 25. In the event that the control unit is defective, perhaps because the batteries are exhausted, the control unit can be removed and the locking device can be activated directly via the transmission board 8 through the gear rim 19. In addition, thanks to the gear rim 12 the transmission board 8 can be connected non-positively to the control unit that is not shown here. As examples, some teeth show reference numbers 26 to 29. In addition, on the front side 20 of transmission board 8 rim 13 with a great number of openings extends from the surface of transmission board 8. This rim 13 shows the positioning, so that the optical sensor allocated to the control unit can record the turns by orienting towards these openings. The scale 17 for the numbers 1 to 100, which correspond to the settings, can also be seen.

Figure 6:
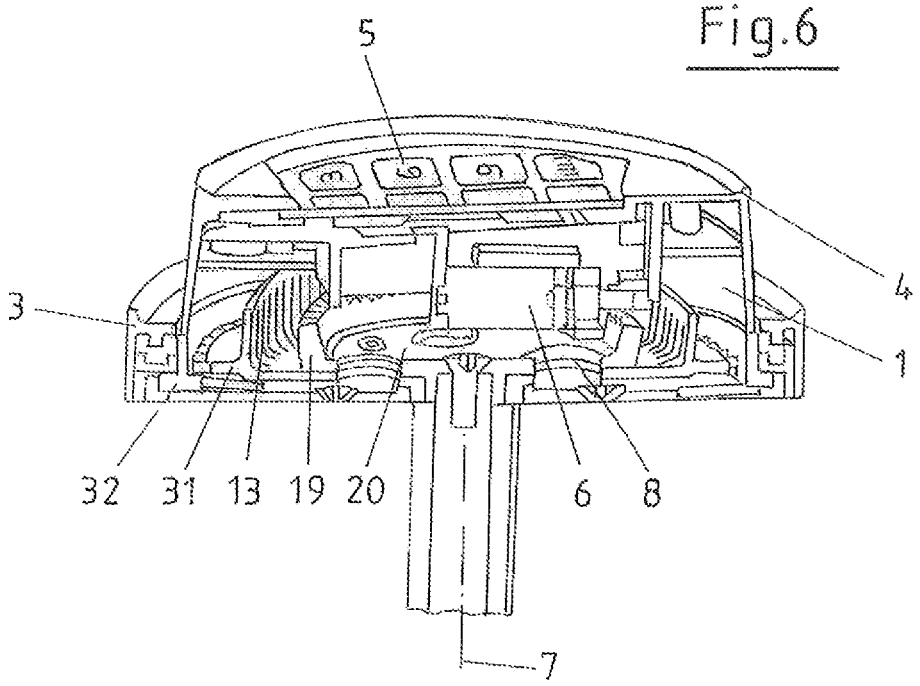
Figure 7:
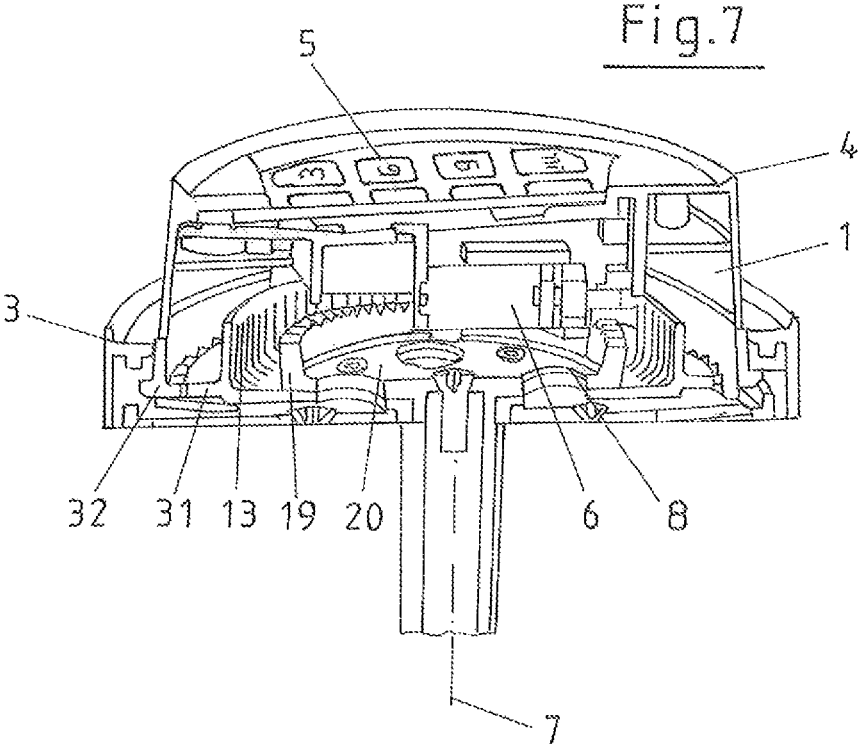

FIGS. 6 and 7 a show an inside view of the control unit 1 in the normal position as shown in FIG. 6 and in the pulled out position as shown in FIG. 7. It be seen clearly that in the former there is no engagement between transmission board 8 and front housing part 4, which can also be seen in that the outer end 31 of the transmission board 8 is not aligned with the web 32 of the front housing part 4; there is no tooth connection.

This is then different in FIG. 7, front housing part 4 was pulled out slightly in the direction of the longitudinal axis 7 of the two housing parts 3, 4, transmission board 8 and front housing part 4 have entered a non-positive connection, the outer end 31 of the transmission board 8 and web 32 are aligned with each other.

Figure 8:
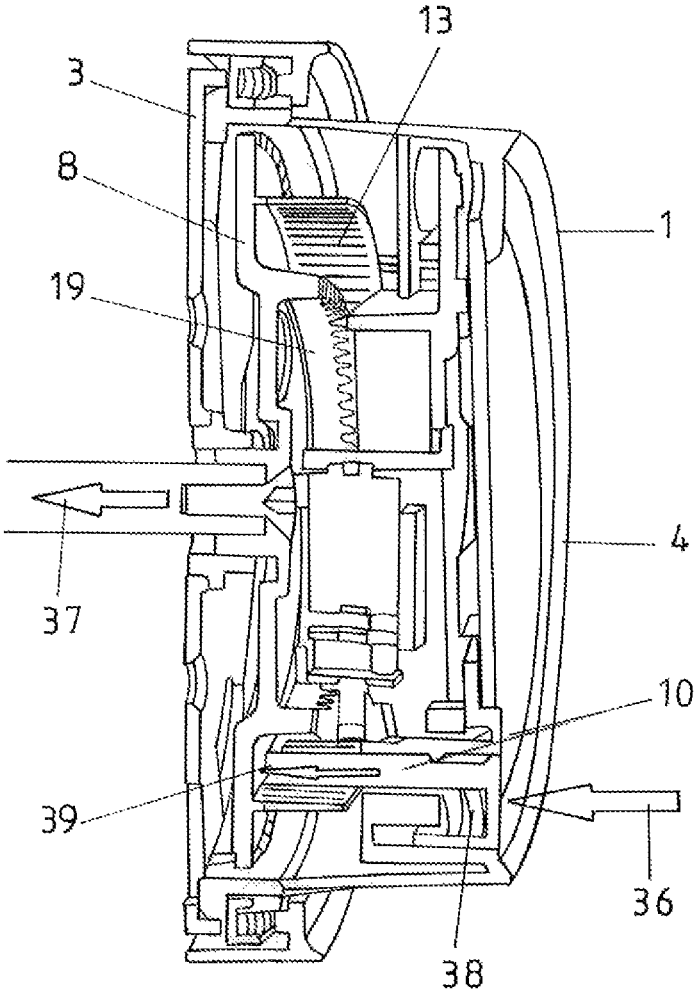
FIG. 8 Shows a cross-section through a housing focussing on the handle.

FIG. 8 shows a cross-section through the housing 2 with a special focus on the handle 10 under the numerical field on the keypad that is arranged against the force of the spring 38. The compression force is then transmitted to the transmission board 8 with the front end 39 of the handle 10. If the handle 10 is namely actuated from outside through pressing in the direction of the arrow 36, this moves the front housing part 4 in the direction of the rear housing part 3 or the safe door, symbolised by the arrow 37.

Figure 9:
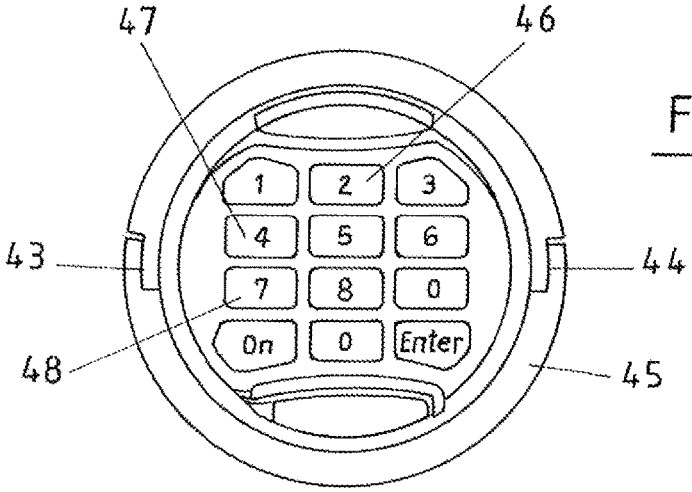
FIG. 9 Shows a control unit with the swivelling handle in the closed state and FIG. 10 Shows a control unit with the swivelling handle in the open state.

FIG. 9 shows a control unit 1 with the folded swivelling handle 45, here in its closing position parallel to the plane of the door. The swivelling handle 45 is mounted in the area of the joints 43; 44 in such a way that it can be swivelled to the at the most to a plane running vertically to the door. Using the swivelling handle 45 is made easier though the provision of the recess. The control unit 1 comprises a lock plate 41 arranged between a base plate 42 to be mounted on the safe door and the keypad of the control unit 1, which is to be turned parallel to the plane of the safe door to lock and/or unlock the safe door. The lock plate 41 is connected to the base plate 42 rotatable by an angle of approx. 90°. Here there is at least one slide guide between the lock plate 41 and the base plate 42 that enables and restricts twisting of the lock plate 41. As an example, three keys are shown with references 46, 47 and 48.

Figure 10:
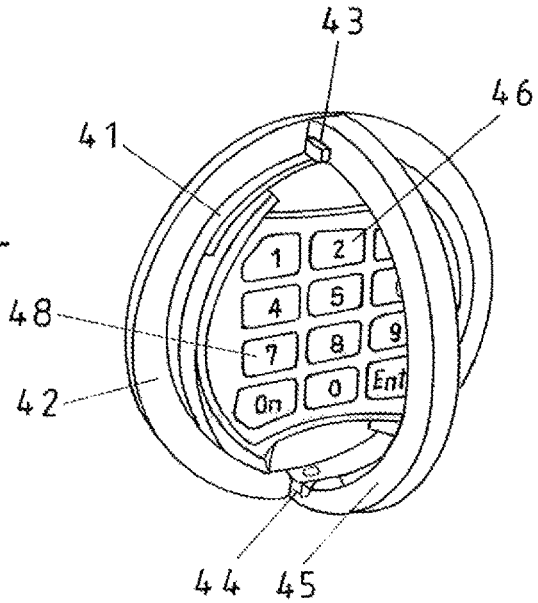

The swivelling handle 45 is then swivelled in the illustration in accordance with FIG. 10, whereby this was swivelled by an additional 90° in a clockwise direction to unlock the lock. In this opening position the swivelling handle 45 is arranged at least approximately vertical to the plane of the safe door.

The invention claimed is:

1. Control unit (1) for a lock of a safe comprising a multipart housing (2) that has a front housing part (3) and a rear housing part (4) detachably coupled to the lock of the safe, wherein a controller (6) is integrated in the control unit (1) that, when a correct combination is entered in a keypad (5), through a motor (11) rotates a module having a transmission board (8) arranged in the housing (2) of the control unit (1) and a bolt (9) for actuating the lock of the safe by the number of turns corresponding with this combination, wherein the front housing part must be pulled outward or pushed inward to turn the bolt.

2. Control unit in accordance with claim 1, wherein release takes place through a control unit (9) that enables manual adjustment of the front housing part (4) with regard to the rear housing part (3) between a normal position and a function position, whereby in the last-mentioned position the front housing part (4) can be rotated against the rear housing part (3).

3. Control unit in accordance with claim 1, wherein the front housing part (4) pivots with regard to the rear housing part (3) in the direction of their joint longitudinal axis (7) between a normal position and a pulled out position.

4. Control unit in accordance with claim 1, wherein a handle (10) is integrated in the front part of the housing (4) through which the front housing part (4) can be moved between the normal position and the function position.

5. Control unit in accordance with claim 1, wherein the keypad (5) is integrated in the front housing part (4).

6. Control unit in accordance with claim 5, wherein the front housing part (4) and the transmission board (8) are non-positively connected to each other in the pulled out position of the front housing part (4).

7. Control unit in accordance with claim 6, wherein a gear wheel connection serves for the non-positive connection.

8. Control unit in accordance with claim 5, wherein a rim (13) extends in the axial direction of the transmission board (8) that shows the turns of the front housing part (4) in interplay with a sensor integrated in the control unit (1).

9. Control unit in accordance with claim 8, wherein the rim (13) has a large number of openings (14-16) that correspond to the coding of the control unit (1).

10. Control unit in accordance with claim 8, wherein the transmission board (8) is fitted with a scale (17) on its front side (20).

11. Control unit in accordance with claim 1, wherein both housing parts (3, 4) are designed to be removed.

12. Control unit in accordance with claim 11, wherein if the front and rear housing parts (3, 4) are removed the transmission board (8) serves to open the lock.

13. Control unit in accordance with claim 12, wherein the transmission board (8) has a gear rim (19) on its front side (20).

14. Control unit in accordance with claim 1, wherein the multipart housing (2) is disposed on the lock of the safe outside the safe, wherein the front housing part (3) and the rear housing part (4) are rotable with respect to each other, and wherein the multipart housing (2) is removable from the lock of the safe when the front housing part (3) and the rear housing part (4) are rotated in opposite directions.

15. Control unit (1) for the lock of a safe with a multipart housing (2) that has a front housing part (3) and a rear housing part (4), wherein a controller (6) is integrated in the control unit (1) that, when a correct combination is entered in the keypad (5), through a motor (11) rotates a module having a transmission board (8) arranged in the housing (2) of the control unit (1) and a bolt (9) for actuating the safe's lock by the number of turns corresponding with this combination, wherein the keypad (5) is integrated in the front housing part (4), wherein a rim (13) extends in the axial direction of the transmission board (8) that shows the turns of the front housing part (4) in interplay with a sensor integrated in the control unit (1), and wherein the rim (13) has a large number of openings (14-16) that correspond to the coding of the control unit (1), wherein the front housing part must be pulled outward or pushed inward to turn the bolt.

* * * * *